United States Patent [19]

Sorkin

[11] 3,939,615

[45] Feb. 24, 1976

[54] FOLDABLE ROOF CONSTRUCTION ELEMENT

[76] Inventor: Roger Sorkin, 17 Dug Road, Lansing, N.Y. 14882

[22] Filed: Apr. 5, 1974

[21] Appl. No.: 458,320

[52] U.S. Cl. ..... 52/80; 52/86; 52/741

[51] Int. Cl.[2] ..... E04B 1/32

[58] Field of Search ..... 52/80, DIG. 10, 18, 81, 52/518, 631, 741; 229/8

[56] References Cited

UNITED STATES PATENTS

| | | | |
|---|---|---|---|
| 2,203,697 | 6/1940 | Rinkel | 229/8 |
| 2,521,184 | 9/1950 | Paige | 229/8 |
| 3,113,435 | 12/1963 | Yont | 52/518 |
| 3,266,201 | 8/1966 | Christ-Janer | 52/18 |
| 3,334,458 | 8/1967 | Leemhuis | 52/303 |
| 3,389,202 | 6/1968 | Waling | 52/80 |
| 3,445,970 | 5/1969 | Nelson | 52/81 |
| 3,450,592 | 6/1969 | Conrad | 52/81 |
| 3,731,449 | 5/1973 | Kephart | 52/631 |
| 3,807,421 | 4/1974 | Geiger | 52/18 |

FOREIGN PATENTS OR APPLICATIONS

| | | | |
|---|---|---|---|
| 623,923 | 8/1961 | Italy | 52/630 |
| 519,577 | 4/1940 | United Kingdom | 229/8 |

*Primary Examiner*—Frank L. Abbott
*Assistant Examiner*—Henry Raduazo
*Attorney, Agent, or Firm*—Lawrence E. Laubscher

[57] ABSTRACT

A foldable construction element for forming roof constructions or buildings is described. The foldable element may consist of a polygonal sheet of paper, cardboard, plastic, or other suitable material which is provided with fold-lines in selected areas thereof. The sheet of material is selectively folded along the fold-lines to form a roof construction or building structure of a desired shape. The folded structure may be reinforced by a coating or layer of any suitable material to provide added structural strength to the final construction. Many shapes of the fold-lines, relative, sizes, and orientations can be chosen to form buildings or roof constructions of selected shapes. Methods are described for the controlled folding of the construction elements for either on or off site assembly of the building or roof construction. Foundation systems are also described for use with the folded construction elements.

26 Claims, 16 Drawing Figures

FOLDABLE ROOF CONSTRUCTION ELEMENT

BACKGROUND OF INVENTION

1. Field of Invention

The present invention relates to a foldable construction element for forming a roof or building construction. More specifically, the present invention relates to a foldable construction element and a method for folding said element into a desired shape suitable for use as a building or roof construction.

2. Description of Prior Art

Foldable construction elements for forming buildings are known in the prior art which consist of a plurality of foldable subelements which are secured together to form a building. These subelements must be secured together by adhesives, bolts, screws or other suitable fastening means. Construction elements of this type are disclosed in U.S. Pat. Nos. 3,407,546; 3,427,767; and 3,443,344.

The prior art foldable construction elements described above suffer from the disadvantage that more than one foldable element must be used to create a building structure and, therefore, these elements must be coupled together. Accordingly, the state of the art has a need for a foldable building construction which may be formed from a single foldable element.

SUMMARY OF INVENTION

Accordingly, it is an object of the present invention to provide a roof or building construction which may be formed from a single polygonal sheet of material.

It is another object of the present invention to provide roof or building constructions of aesthetically appealing shapes and designs.

It is still another object of the present invention to provide a roof or building construction which can be quickly and efficiently formed at building sites with a minimum amount of labor.

It is a further object of the present invention to provide an inexpensive roof or building construction having improved strucutral strength.

It is still a further object of the present invention to provide foundation means suitable for use with the roof or building construction of the present invention.

It is yet another object of the present invention to provide methods for erecting said roof or building constructions on said suitable foundations.

The objects of the present invention are fulfilled by providing a polygonal sheet of material having score or fold-lines formed therein of selected shapes and at selected locations to facilitate the formation of a roof or building construction of a desired shape when said sheet is selectively folded along said fold-lines. The polygonal sheet of the present invention contains along at least one edge thereof two parallel arc-shaped fold-lines which enclose an intermediate area of said sheet along said edge. In the preferred embodiments of the present invention the fold-lines are either circular, elliptic, or formed as Gothic arcs.

In the first and second embodiments of the present invention the polygonal sheet is either a rectangle or a square, respectively. In these embodiments a apair of substantially parallel arc-shaped fold-lines are provided along each edge for intersection therewith. The fold-lines are substantially semi-circular in shape and symetrically spaced with respect to the corners of the rectangle or square. The semicircular fold-lines intersect the edges of the sheet at points adjacent the corners of the sheet and the points closest to the corners are connected by straight fold-lines across said corners. By grasping the corners and constraining them inwardly along the diagonals of the rectangle or square an aesthetically pleasing bowl-shaped roof or building structure can be formed. The corners could also be pulled inwardly by a suitable cable and winch system.

It has been discovered that a particularly suitable structure can be formed if the distance between the two parallel fold-lines of each set is 0.05 times the length of the shorter edge of the rectangle or one of the edges of the square. The length of each intermediate section along each edge enclosed by the outer circular fold-lines is chosen to be approximately 0.7 times the length of the respective edge.

In a third embodiment of the present invention an elongated bowl-shaped structure can be formed by providing on each of the longer edges of a rectangular sheet four circular fold-lines. The two intermediate fold-lines of each set of four are substantially concentric or parallel with each other. Such is also the case with the inner and outer fold-lines of each set of four. However, the intermediate fold-lines are formed from circles having a lesser radius than the radius of the circle from which the inner and outer fold-lines are formed. The outer fold-line of each set of four may intersect the opposite short edges of the rectangular sheet. The elongated bowl-shaped structure can be formed by bending the sheet along the circular fold-lines in opposite directions beginning at the long edges of the rectangle. This facilitates the formation of an elongated bowl-shaped structure wherein the elongated sides are substantially stair-stepped.

In a fourth embodiment of the present invention a continuous or elongated web of sheet material may be provided with a repeating pattern of fold-lines thereon which define a plurality of repeating like sections. Accordingly, a roof construction of any desired length may be chosen by cutting the sheet to a predetermined length to thereby include a desired number of like sections.

The polygonal sheet for use with the present invention may consist of any suitable type of paper, cardboard, or plastic. If paper is used, said paper may be made with an aceteline solvent so as to be waterproof. Also, if desired the paper may be fabricated from fiberglass fibers. The ideal paper would be a white glass-filled high quality paper.

The paper of the present invention could comprise part of a laminated structure. For example two layers of paper could be provided with a reinforcing metal foil sandwiched in between. The paper could be secured to the metal foil by layers of vulcanizing rubber. The metal foil could either be continuous or it could be provided with perforations to decrease the weight and form a better bond with the rubber.

In another embodiment the metal foil of the laminate could be replaced by a metal screed formed of woven steel cable.

In still another embodiment the metal foil in the laminate could be replaced by a flexible plastic material which could either be a continuous or perforated sheet.

In yet another embodiment the rubber layers of the laminate could be eliminated and the perforated metal foil or steel cable screen could be pressed into the paper layers to form a direct paper-to-metal bond.

Numerous different foundation constructions could be used for supporting the roof or building construction once it has been erected. The only essential feature of the foundation construction is that means be provided for securing the lower edges against movement in a horizontal plane once the structure has been erected.

The folded construction element of the present invention can be used either as a roof construction or as the main structure of a building per se. If used as a roof construction the folded element may be secured by suitable means to the top of the building walls. If used as the main structure of the building, the folded element can be directly secured to the building foundation.

The folded construction element can be used without further treatment as a temporary structure. However, to provide added structural strength and longer life, the structure can be coated with concrete, plastic, fiber glass, or any other suitable material once the element is folded into the desired shape.

The fold-lines in sheets of the present invention may be formed by punching, scoring, pressing or any other suitable means to provide weakened lines in the surface of said sheet.

BRIEF DESCRIPTION OF DRAWINGS

Other objects of the present invention and the attendant advantages thereof will become more apparent with reference to the following description of the drawings wherein:

Referring to FIGS. 1, 2 and 3, a first embodiment of the invention is described.

FIG. 1 shows a rectangular flat sheet formed from plastic material, cardboard, or a suitable laminate to be described hereinafter including several fold-lines. The sheet comprises two longer edges, 1, 2 and two shorter edges 3, 4. These edges are intersected by two substantially parallel, arc-shaped fold-lines extending toward the central portion of the sheet. The fold-lines 5, 6; 7, 8; 9, 10; 11, 12 are formed by circular lines. As illustrated in FIG. 1, the fold-lines 9, 10; 11, 12 are formed by complete semi-circles, while fold-lines 5, 6; 7, 8 are formed by circular arcs which are not complete semi-circles. The points of intersection of the edges 1, 2, 3, 4 with the outer fold-lines 6, 8, 10, 12 are connected across the four corners of the sheet by straight fold-liines 13, 14, 15, 16. The corners 17, 18, 19, 20 formed by these fold-lines may be separated or used as tongues to fix the roof at the four corners as will become more fully apparent hereinafter.

A sheet of this kind may be prepared from endless or plate-shaped material in a simple manner by punching the fold-lines 5 to 16 by one punching step to form weakened lines. The element according to the invention is thus ready for use without needing further working steps.

In a preferred embodiment fold-lines 5, 7, 9, 11 and 13 to 16 are punched or cut on the underside of the rectangular sheet and fold-lines 6, 8, 10 and 12 are punched or cut on the upper side of the sheet to facilitate the bending of the sheet along these fold-lines in preferred directions to be described hereinafter.

Figure 1:
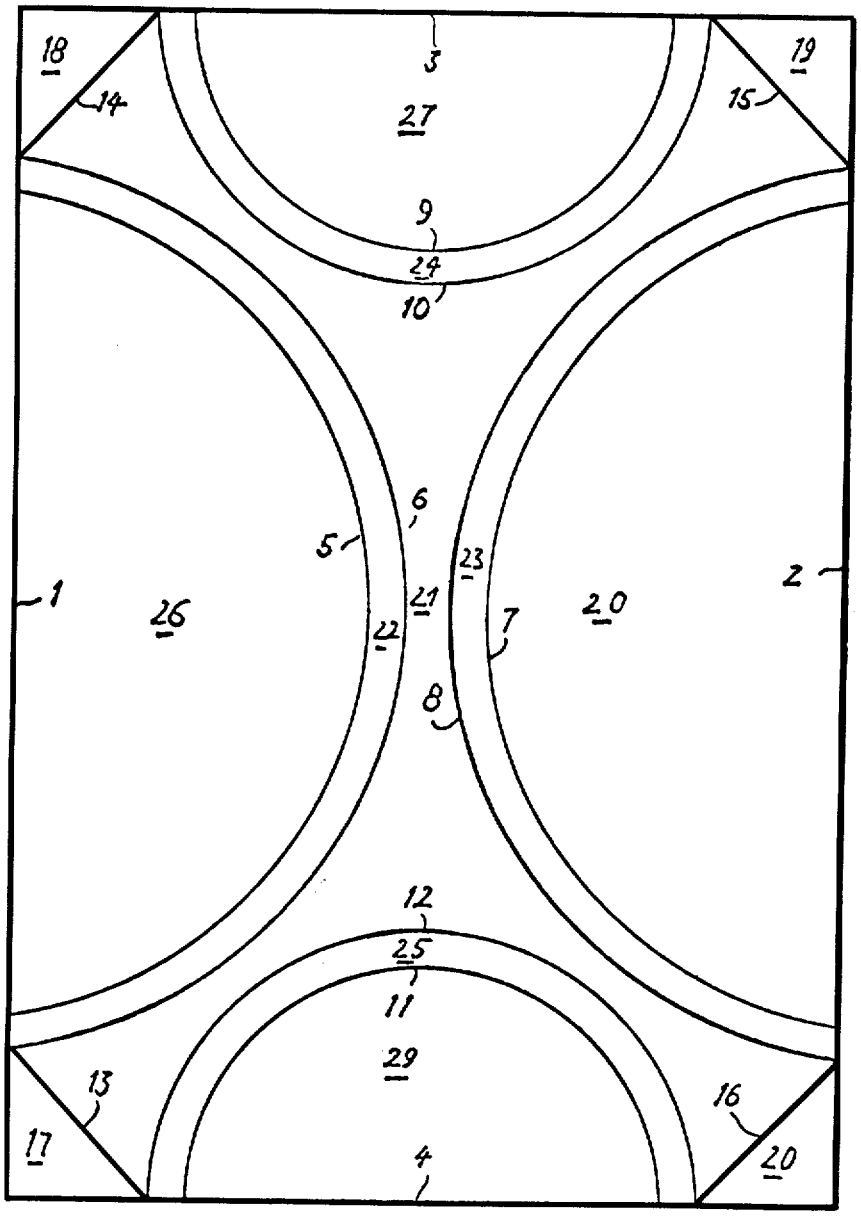
FIG. 1 is a plan view of a rectangular sheet according to the invention before folding.
Figure 2:
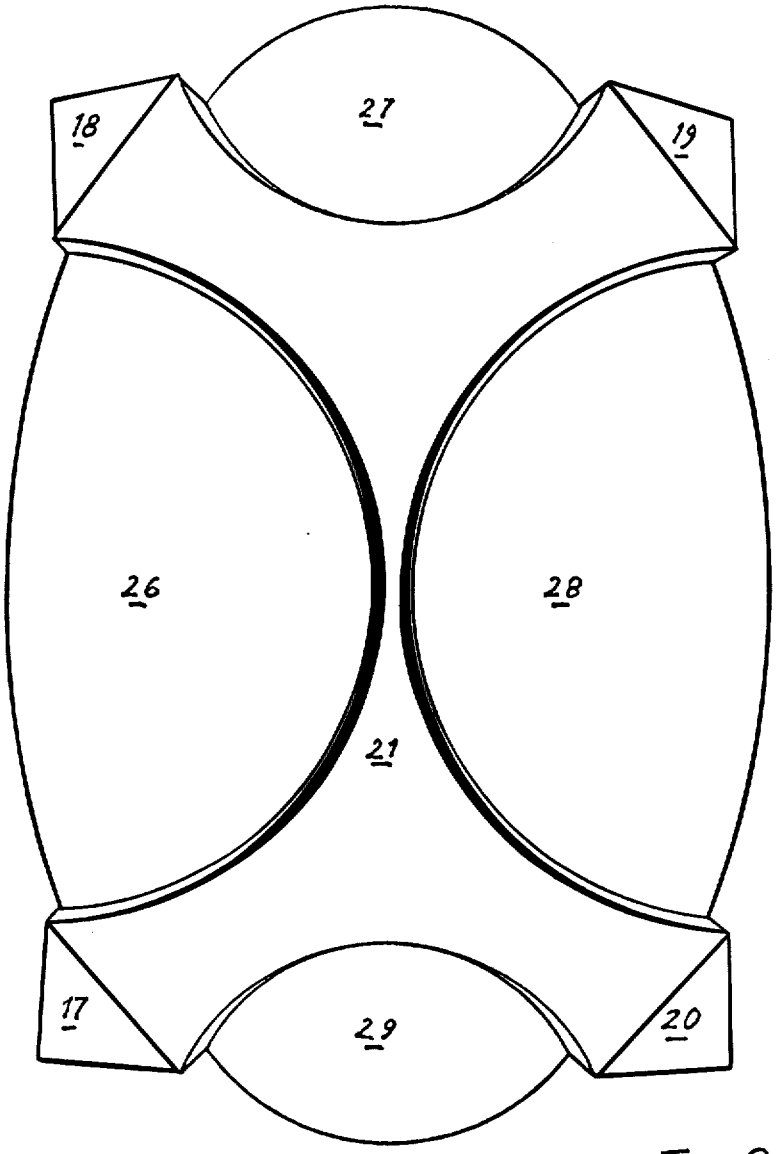
FIG. 2 is a top plan view of the same sheet after folding.
Figure 3:
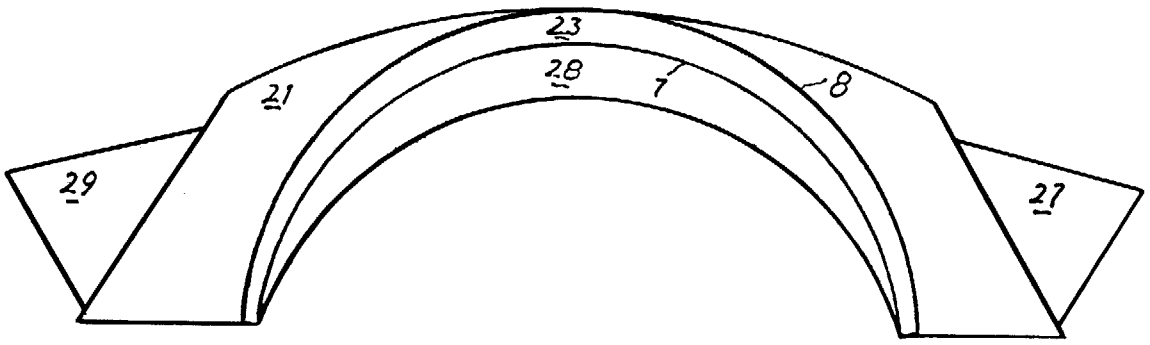
FIG. 3 is a side elevation of the folded sheet of FIG. 2.

To form the bowl-shaped structure of FIGS. 2 and 3 the rectangular sheet of FIG. 1 is grasped at the four corners 17, 18, 19, 20 and the corners are pushed inwardly in a horizontal plane along the diagonals of the rectangle. That is corners 17 and 19 are pushed toward each other and corners 18 and 20 are pushed toward each other in a like manner. Thus, the area 21 between the outer fold-lines 6, 8, 10, 12 rises to form a dome substantially in the shape of a central I-beam. As area 21 reises as described above, the areas 22, 23, 24, 25 between the respective fold-lines tend to become folded downwardly along fold-lines 6, 8, 10, 12 which are punched in the top of the sheet, and areas 26, 27, 28, 29 inside the inner fold-lines 5, 7, 9, 11 tend to become folded upwardly along fold-lines 5, 7, 9, 11, which are punched in the bottom of the sheet. Corner sections 17 to 20 are of course folded upwardly along fold lines 13 to 16, which are punched on the underside of the sheet.

The folding of the sheet of FIG. 1 may be performed by a cable and winch system to be described hereinafter with respect to FIG. 11. Some supervision or assistance might be necessary to the folding operation to assure that all folding of the respective sections about the fold-lines is performed in the proper directions without the formation of kinks or extra folds in the section. Accordingly, it may be necessary to smooth out said kinks or folds by suitable means as corners 18 to 20 are constrained inwardly.

As shown in the side elevational view of FIG. 3, the curvature of area 28 forms an opening in which a window or door could be mounted.

Figure 4:
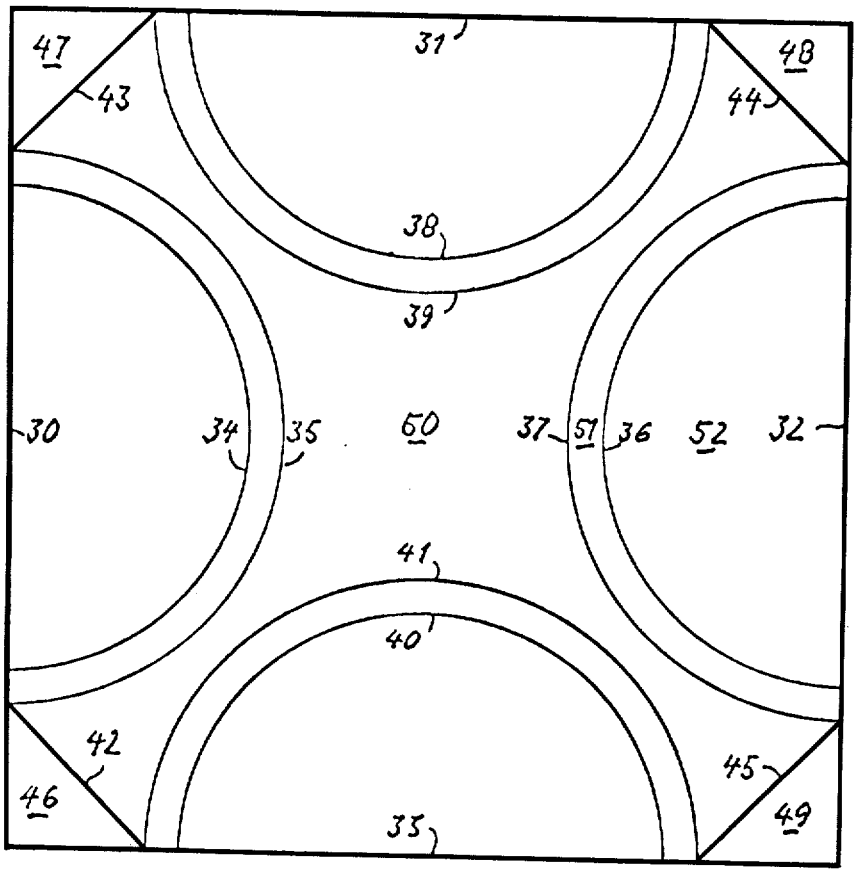
FIG. 4 is a plan view of a square-shaped sheet according to the invention.
Figure 5:
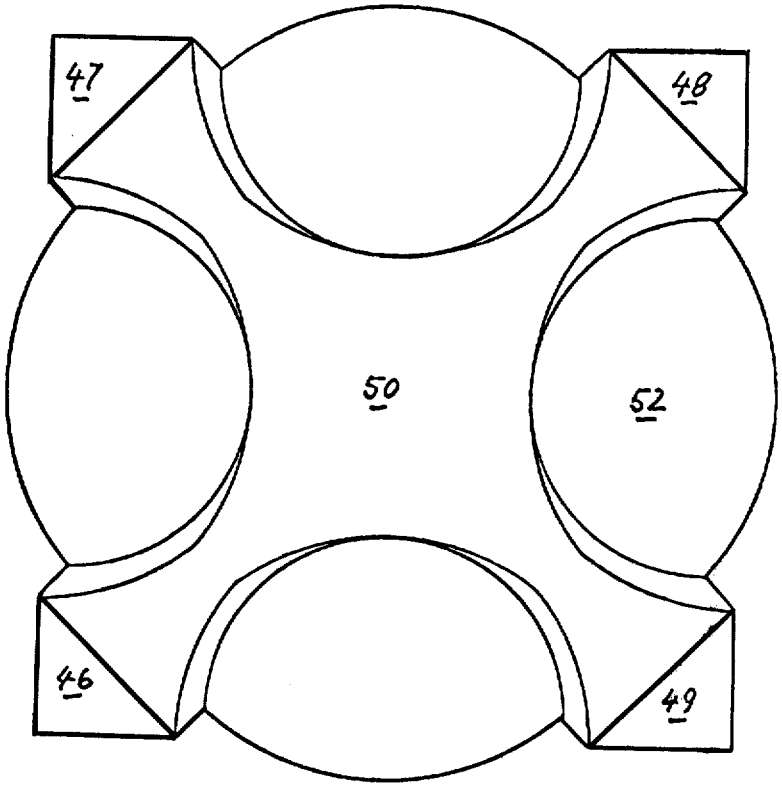
FIG. 5 is a top plan view of the sheet of FIG. 4 after folding.
Figure 6:
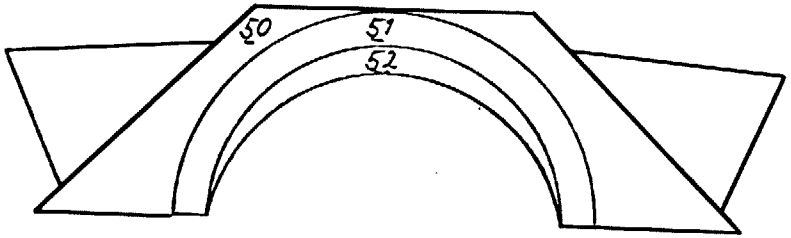
FIG. 6 is a side elevation of the folded structure of FIG. 4.

A second embodiment of the present invention is illustrated in FIGS. 4 to 6 wherein the polygonal sheet comprises a square having four equal edges 30, 31, 32, 33. Each of the edges is intersected by a pair of substantially parallel semicircular fold-lines 34, 35; 38, 39; 36, 37; 40, 41, respectively. The points of intersection of outer fold-lines 35, 37, 39, 41 are interconnected across the corners of the square by straight fold-lines 42 to 45 to define corner sections 46 to 49.

In a preferred embodiment fold-lines 34, 36, 38, 40, and 42 to 45 are punched or cut on the top side of the sheet to facilitate the bending of the sheet in preferred directions as corners 46 to 49 are constrained inwardly along the diagonals of the square.

To erect the bowl-shaped structure of FIGS. 5 and 6 the four corners 46, 47, 48, 49 are moved inwardly in the direction of the middle of the sheet. Thus the area 50 inside the fold-lines 35, 37, 39, 41 reises up. Folding of the remaining areas follows in the same way as with the embodiment of FIGS. 1 to 3 and thus is only described with reference to the side 32. The area 51 between the fold-lines 36 and 37 is folded down in comparison with the area 50 along the fold-line 37, and the area 52 is folded up along the fold-line 36 compared with the area 51. Thus the area 52 forms a kind of arch which may be used as opening for windows and doors.

FIG. 5 shows this square sheet element in the erected position after folding in plan view.

FIG. 6 is side elevation of this erected bowl seen from the right side in FIG. 5 which illustrates that the area 52 forms a useful opening for windows or doors.

Figure 7:
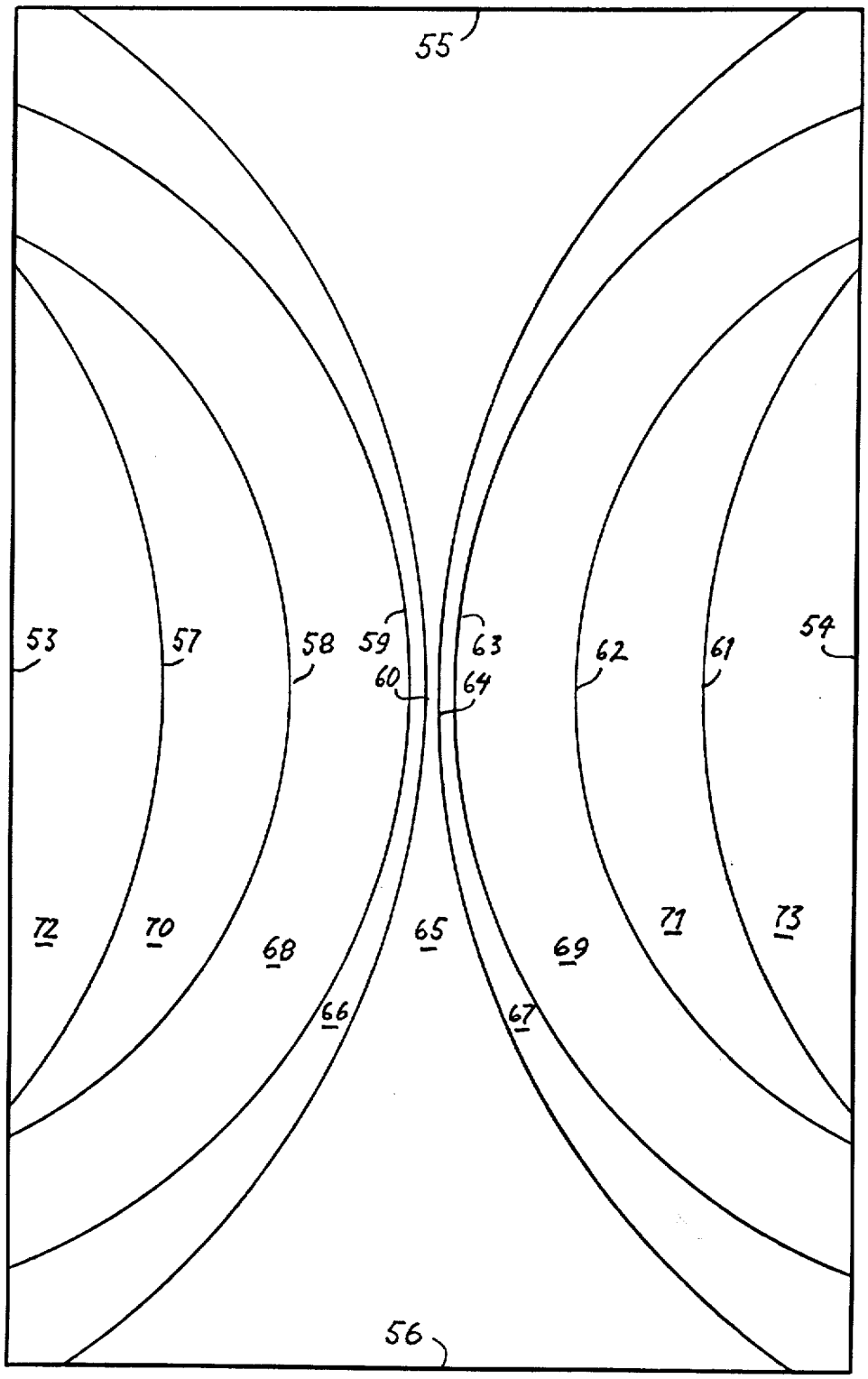
FIG. 7 is a plan view of a further embodiment of a sheet according to the invention before folding.
Figure 8:
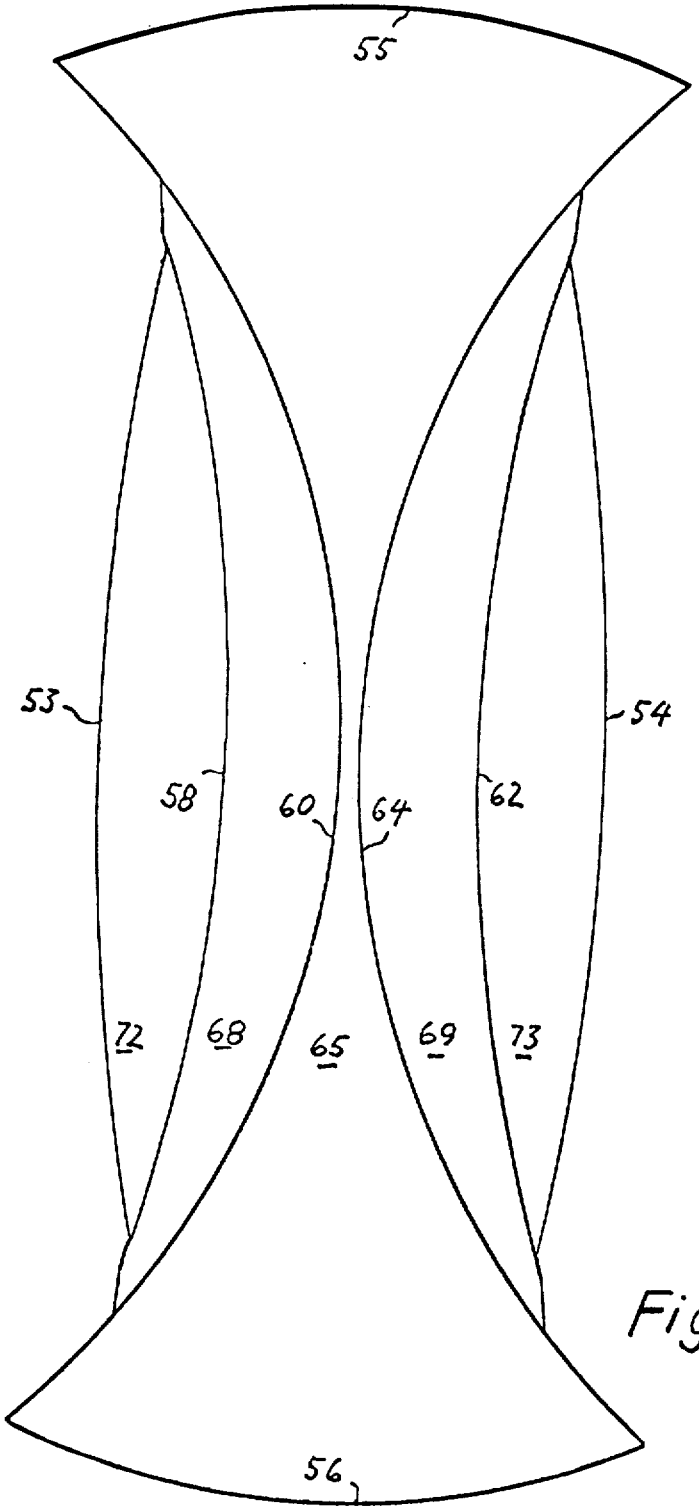
FIG. 8 shows the sheet of FIG. 7 after folding.
Figure 9:
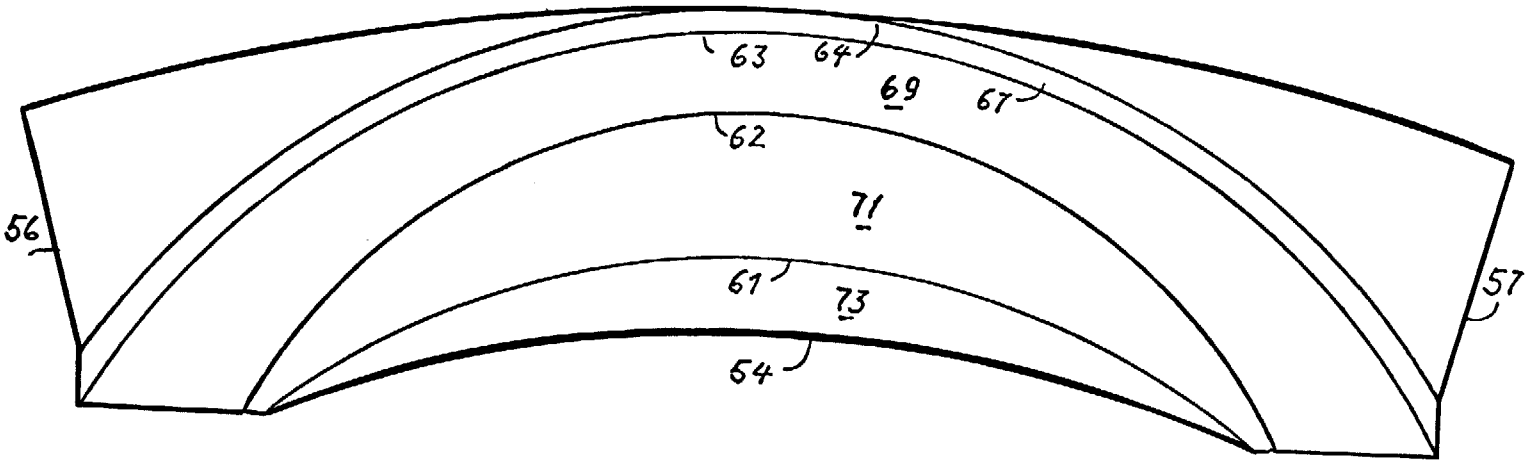
FIG. 9 is a side elevation of the folded structure of FIG. 8.

A third embodiment of the invention is shown in FIGS. 7, 8 and 9. In this case the sheet is rectangular and the fold-lines extend along the two longer edges 53 and 54 of the rectangle. This embodiment is particularly useful to form elongated roof constructions.

The two longer edges 53, 54 are each bordered by four fold-lines 57, 58, 59, 60; 61, 62, 63, 64. These fold-lines are formed by comparatively short circular sections and thus the roof is stretched in the direction of the short edges 55, 56. As shown in the drawings the two intermediate fold-lines 58, 59 and 62, 63 of the two groups of fold-lines are substantially parallel and concentric, while the inner and outer fold-lines 57, 60 and 61, 64 have a larger radius, but are substantially parallel with each other. In this embodiment as shown in the drawings the outer fold-lines 60, 64 intersect the short edges 55, 56 of the rectangle.

In a preferred embodiment to facilitate the bending of the respective sections bordered by the fold-lines of FIG. 7 in the proper directions, the fold-lines are alternately punched or cut on opposite sides of the rectangular sheet. That is fold-lines 57, 59, 61, 63 are punched or cut on the underside of the sheet and the fold-lines 58, 60, 62, and 64 are punched or cut on the top side thereof.

The roof construction according to FIGS. 8 and 9 is formed by erecting this sheet. For this purpose the longer sides 53 and 54 are pushed toward the middle of the sheet. It is necessary to watch that the folding of the respective sections occurs alternate directions thus forming a step-shaped construction. In comparison with the upper area 65 the areas 66 and 67 are folded down along the fold-lines 60 and 64. The areas 68 and 69 are folded up along the fold-lines 59 and 63 i.e. they are folded in a substantially horizontal plane. The areas 70 and 71 are folded down along the fold-lines 58 and 62 and the areas 72 and 73 are folded up along the fold-lines 57 and 61. By these fold-lines the roof construction is substantially stabilized. By this folding process the shorter sides 55 and 56 of the rectangle define arc-shaped openings to provide openings for doors or windows.

FIG. 8 shows the plane sheet of FIG. 7 after folding. In this top view only the areas 65, 68, 69 and 72, 73 may be seen, while the areas 66, 67 and 70, 71 are perpendicular to the plane of FIG. 8.

FIG. 9 shows a side elevation of the construction according to FIG. 8 seen from the right side in this figure. The same fold-lines are provided with the same reference numbers.

Figure 10:
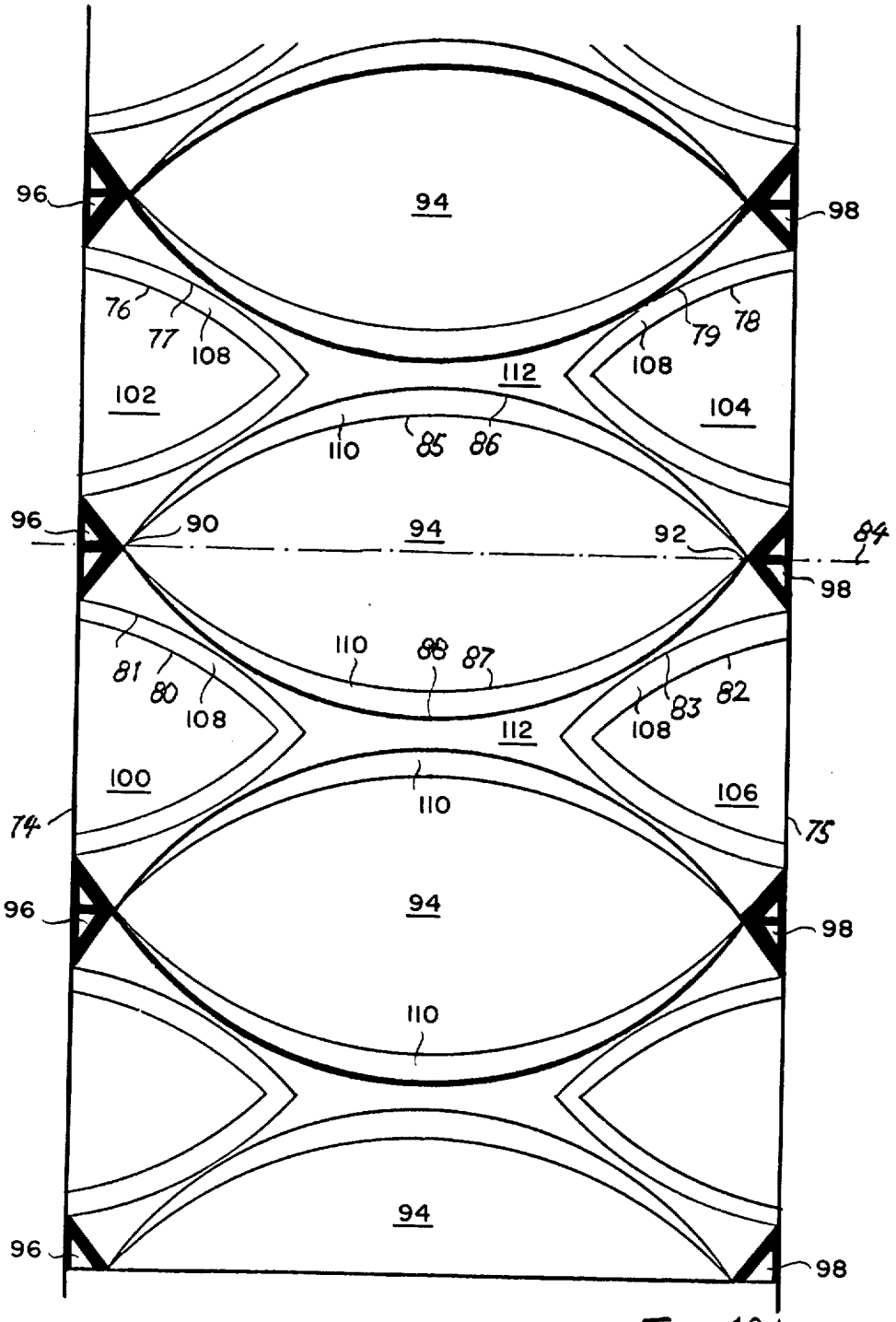
FIG. 10 is a plan view of an unfolded sheet in form of an endless-web.

FIG. 10 illustrates an endless web according to a fourth embodiment of the present invention which may be prepared by adding several sheets according to FIG. 1 and amending the fold-lines to some extent. By this endless web roof constructions of any desired length may be formed, if the web according to FIG. 10 is pushed together in the longitudinal direction.

As illustrated in FIG. 10 an endless rectangular web or sheet of material is provided with a repeating pattern thereon. A complete pattern or section is illustrated with numerals in FIG. 10 symmetrically disposed about a transverse center line 84 which intersects edges 74, 75. A single pattern or section includes a pair of arcs 85, 86 and 87, 88 on opposite sides of center line 84. The arcs intersect center line 84 at points 90 and 92 to define an elliptical central area 94 and the extension of the arcs past points 90 and 93 intersect edges 74, 75 to form side areas 96, 98. The single pattern or section further includes a pair of Gothic shaped arcs along each edge 74, 75, the Gothic arcs of each pair being symmetrically disposed with respect to center line 84 on opposite sides of elliptical area 94. The pairs of Gothic arcs are also aligned in the transverse direction of the sheet. The Gothic arcs are defined by pairs of fold-lines 76, 77; 78, 79; 80, 81; and 82, 83. The areas between the above Gothic arcs and edges 74, 75 are designated 100, 102, 104, 106, respectively, while the areas between the pairs of arcs are designated 108. The pattern or section then repeats or continues along the sheet in a like manner.

To form a roof from this web a thrust is necessary along the edges 74, 75 and in longitudinal direction of the web. Thus the sheet is folded as basically explained above. For example the area 108 along the fold-line 77 is folded down and the area 102 along the fold-line 76 is folded up. Furthermore the area 110 along the inner fold-line 86 it is folded down and the area 94 along the fold-line 85 parallel with the fold-line 86 it is folded up, thus a stabilizing small intermediate area is formed. The areas 112 between the ellipses are folded up.

The endless web of FIG. 10 can be cut along any center line passing through areas 92, 98 located on edges 74, 75 respectively to select a roof construction of a predetermined length.

Figure 11:
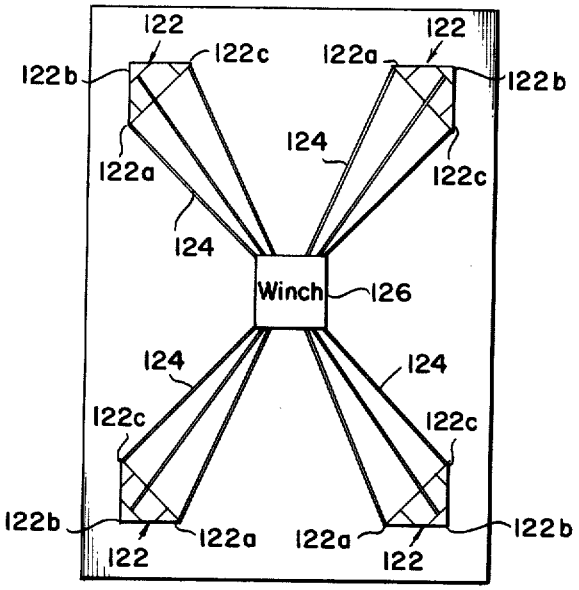
FIG. 11 illustrates in diagromatic form a system and method for erecting the construction elements of FIGS. 1 to 6.

FIG. 11 illustrates in diagrammatic form a system for erecting the construction elements of FIGS. 1 to 6 as a building on a foundation generally designated 120. Foundation 120 may comprise a concrete slab or merely a rectangular section of ground. A plurality of triangular corner brackets 122 for receiving the corners of the foldable elements of either FIGS. 1 or 4 are provided. Since the foundation 120 is rectangular, let us assume for the purpose of illustration that the corners 17 to 20 of the rectangular element of FIG. 1 are to be inserted in the corner brackets 122. Corner brackets 122 may comprise two triangular sheets of metal joined along two sides with the third side open to define a slot for receiving corners 17 to 20 of the foldable element of FIG. 1. A plurality of cables are secured to each of the corners 122A, 122B, 122C of the brackets. Corners 122A, 122B, 122C may be reinforced to add structural strength to brackets 122 and cables 124 are secured to these reinforced areas. Cables 124 are secured at the opposite ends thereof to a centrally located winch 126. Cables 124 may comprise braided steel or nylon.

In operation corners 17 to 20 of the element of FIG. 1 are placed in brackets 122 or the cables and winch 126 is actuated. Winch 126 winds and pulls cables 124 inwardly and in so doing pulls brackets 122 inwardly along the diagonals of rectangular foundation 120. This causes the construction element of FIG. 1 to be erected into the bowl-shaped structure of FIGS. 2 and 3. Once the bowl-shaped structure is formed brackets 122 may be secured to foundation 120 and cables 124 can be removed. However, in the alternative cables 124 and winch 126 can be locked in place and set in concrete to provide permanent structural strength for the building.

Figure 12:
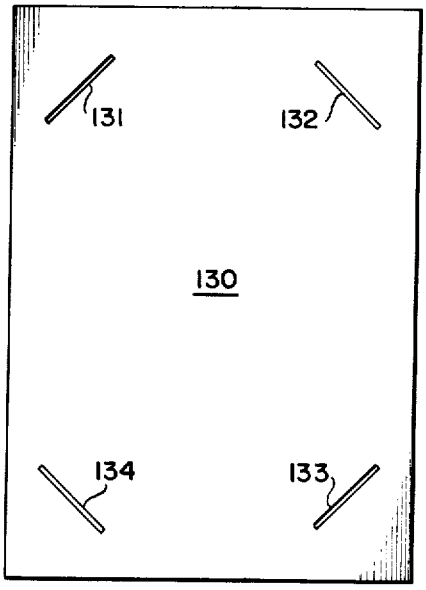
FIGS. 12 and 13 illustrate forms of foundation means suitable for use with the construction elements of the present invention.
Figure 13:
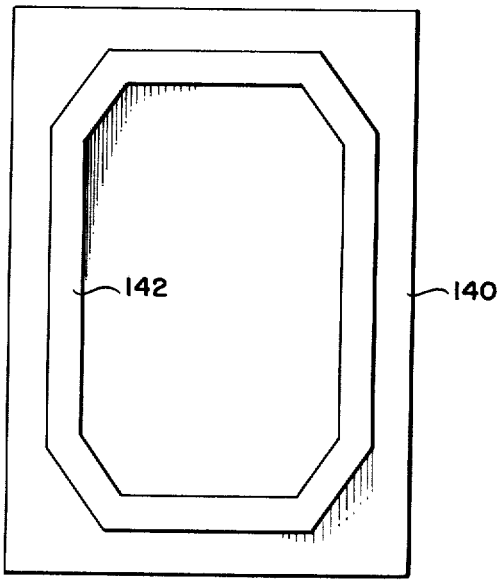

FIGS. 12 and 13 illustrate other forms of foundation means suitable for use with the present invention.

As shown in FIG. 12 the foundation may consist of a rigid base plate, 130 fabricated from metal, plastic, or any other suitable material. A plurality of slits 131 to 134 may be provided therein to receive the corners 17 to 20 of the rectangular construction element of FIG. 1. The slits 131 to 134 define a rectangular area which is smaller then that of the sheet of FIG. 1. Accordingly, when corners 17 to 20 are inserted into slits 131 to 134 the element of FIG. 1 pops-up to form the bowl-shaped structure of FIGS. 2 and 3.

As shown in FIG. 13 the foundation may also take the form of a concrete slab 140 having in inner curb or ridge formed thereon. In operation the corners 17 to 20 of the element of FIG. 1 are constrained inwardly and secured inside of curb 142 thus forming the bowl-shaped construction of FIGS. 2 and 3. Curb 142 provides structural strength to the base of the resulting bowl-shaped construction by preventing any outward movement of corners 17 to 20. Curb 142 may also be rectangular or any other desired shape.

Figure 14:
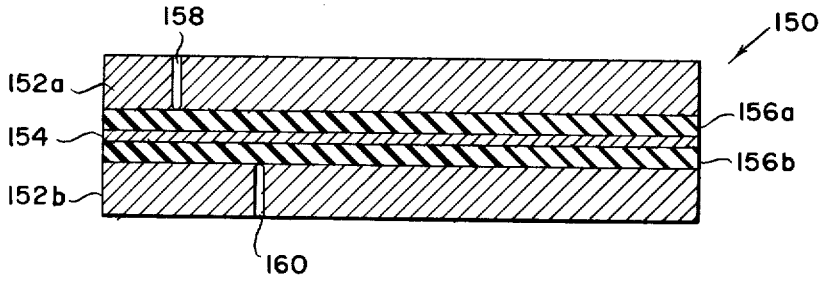
FIGS. 14 to 16 illustrate various forms of laminates suitable for use with the present invention.
Figure 15:
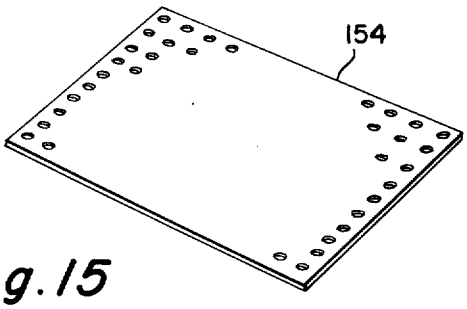
Figure 16:
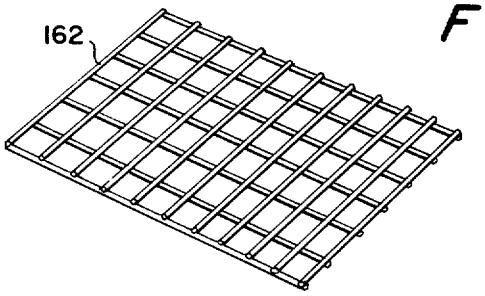

FIGS. 14 to 16 illustrate various forms of a laminate which may be used for the polygonal sheets of the present invention.

Referring to FIG. 14 there is illustrated a laminate generally designated 150 including outer paper layers 152A, 152B having sandwiched therebetween a metal foil 154. Metal foil 154 may be bonded to paper layers 152A, 152B by vulcanizing rubber layers 156A, 156B, respectively. Rubber layers 156A, 156B may of course be replaced by any suitable flexible adhesive means. As shown at 158, 160 fold-lines may be scored or punched on either surface of the laminate through either paper face but not into the central region of the laminate. Accordingly, laminate 150 may be folded about the flexible interior layers of the laminate.

As shown in FIG. 15 the metal foil 154 may be perforated to decrease the weight thereof. In this embodiment rubber layers 156A, 156B may be eliminated by pressing foil 154 with its perforations directly into paper layers 152A, 152B thus forming a direct paper to metal bond.

As illustrated in FIG. 16 metal foil 154 may be replaced by a woven steel screen 162. Of course any other suitable material may be used in place of foil 154. For example a perforated flexible plastic sheet could be employed.

The apparatus, articles, and methods described herein could be modified by one of ordinary skill in the art without departing from the spirit and scope of the present invention.

What is claimed is:

1. A foldable construction element for forming a roof construction, comprising a. a plane four-sided polygonal sheet containing at least four sets of fold lines associated with the edges of said sheet, respectively, thereby to cause each of the edges of said sheet to be intersected by at least one of said sets of fold lines;

b. each of said fold-lines of said set defining a curve which extends from a first point of intersection with the associated edge inwardly toward a central region of said sheet and back to a second point of intersection on said associated edge, whereby upon selective folding of the sheet along the fold lines, a three-dimensional structural body of desired configuration is obtained.

2. The foldable construction element of claim 1 wherein said fold-lines are circular.

3. The foldable construction element of claim 1 wherein said fold-lines are elliptic.

4. The foldable construction element of claim 1 wherein said fold-lines are in the shape of Gothic arcs.

5. The foldable construction elements of claim 1 wherein each of said sets of fold-lines are symmetrically disposed along each of said edges and the outermost points of intersection of said fold-lines of each set with said edges are connected across the corners of said rectangle with straight fold-lines.

6. The foldable construction element of claim 5 wherein each of said sets of fold-lines comprise two concentric semicircular arcs.

7. The foldable construction element of claim 6 wherein the distance between the respective fold-lines of each set is approximately 0.05 times the length of the shorter edge of the rectangle and the distance between said outermost points of intersection of the fold-lines along a given edge is 0.7 times the length of said given edge.

8. The foldable construction element of claim 7 wherein the fold-line of each set which is within the other fold-line of said set is formed on the bottom side of said polygonal sheet and the outer fold-line of each set is formed on the top side of said sheet, whereby said sheet is foldable in opposite directions along the respective fold-lines of each set.

9. The foldable construction-element of claim 8 wherein said straight fold-lines across the corners of said rectangle are formed on the bottom side of said sheet.

10. The foldable construction element of claim 1 wherein said polygonal sheet is a square.

11. The foldable construction element of claim 10 wherein each of said sets of fold-lines are symmetrically disposed along each of said edges and the outermost points of intersection of said fold-lines of each set with said edges are connected across the corners of said square with straight fold-lines.

12. The foldable construction element of claim 11, wherein each of said sets of fold-lines comprise two concentric semi circular arcs.

13. The foldable construction element of claim 12, wherein the distance between the respective fold-lines of each set is approximately 0.05 times the edge of the square and the distance between said outermost points of intersection of the fold-lines along a given edge is 0.7 times the length of said given edge.

14. The foldable construction element of claim 13 wherein the fold-line of each set which is within the other fold-line of said set is formed on the bottom side of said polygonal sheet and the outer fold-line of each set is formed on the top side of said sheet, whereby said sheet is foldable in opposite directions along the respective fold-lines of each set.

15. The foldable construction element of claim 14 wherein said straight fold-lines across the corners of said rectangle are formed on the bottom side of said sheet.

16. The foldable construction element of claim 1 wherein said polygonal sheet comprises an endless web having a repeating pattern of fold-lines thereon, said repeating pattern including in alternation an elliptical pattern of fold-lines symmetrically disposed with respect to the edges of said web and a pair of Gothic arc patterns disposed in alignment with each other on opposite edges of said web, the apices of said Gothic arcs pointing inwardly of the edges of said web, said Gothic arcs beginning and ending on the respective edges of said web.

17. The foldable construction of claim 16 wherein each of said elliptical and Gothic arc patterns consists of two spaced and substantially parallel fold-lines.

18. The foldable construction element of claim 1 wherein said polygonal sheet is formed from paper.

19. The foldable construction element of claim 1 wherein said polygonal sheet is formed from cardboard.

20. The foldable construction element of claim 1 wherein said polygonal sheet comprises a laminate including first and second paper layers and a flexible inner layer.

21. The foldable construction element of claim 20 wherein said flexible inner layer comprises a perforated metal foil bonded directly to said paper layers.

22. The foldable construction element of claim 20 wherein said flexible inner layer comprises metal bonded to said first and second paper layers by rubber.

23. The foldable construction element of claim 22 wherein said metal is a continuous foil.

24. The foldable construction element of claim 22 wherein said metal is a perforated metal foil.

25. The foldable construction element of claim 22 wherein said flexible inner layer is woven steel screen.

26. The foldable construction element of claim 20 wherein said flexible inner layer is plastic.

* * * * *